United States Patent [19]

Bretschneider et al.

[11] 3,930,395

[45] Jan. 6, 1976

[54] ROLLING MILL

[75] Inventors: Erich Bretschneider, Meerbusch; Hermann Leitner, Langenfeld; Friedhlem Böhmer, Neuss, all of Germany

[73] Assignee: Schloemann-Siemag Aktiengesellschaft, Dusseldorf, Germany

[22] Filed: Apr. 14, 1975

[21] Appl. No.: 567,606

[30] Foreign Application Priority Data

Apr. 17, 1974 Germany ..... 2418454

[52] U.S. Cl. ..... 72/228; 72/251; 72/225

[51] Int. Cl.[2] ..... B21B 1/18; B21B 41/08

[58] Field of Search ..... 72/234, 235, 226, 227, 72/228, 251, 187, 190

[56] References Cited

UNITED STATES PATENTS

| | | | |
|---|---|---|---|
| 407,177 | 7/1889 | Daniels | 72/228 |
| 3,383,896 | 5/1968 | Blinn | 72/226 |
| 3,533,260 | 10/1970 | Marcovitch | 72/190 |
| 3,561,105 | 2/1971 | Cofer | 164/76 X |

*Primary Examiner*—Milton S. Mehr
*Attorney, Agent, or Firm*—Norman S. Blodgett; Gerry A. Blodgett

[57] ABSTRACT

Rolling mill for high production capacity and large bundle weights using one furnace followed by a roughing line and with separate intermediate- and finish-roll lines for each roll line.

4 Claims, 1 Drawing Figure

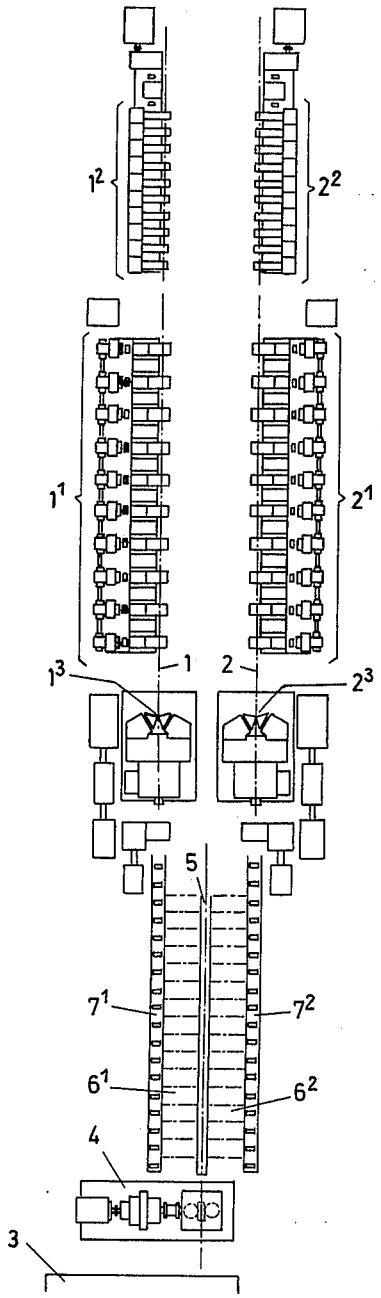
1²
2²
1¹
2¹
1³
1
2
2³
5
7¹
7²
6¹
6²
4
3

ROLLING MILL

BACKGROUND OF THE INVENTION

It is well known that the productive capacity of a multiple wire-rod rolling mill train is mainly determined by four factors; it depends on the base cross section of the billet within the roughing line, on the length of the billets entering the roughing line, on the number of rolling lines, and finally on the rod delivery speed.

Practical experience, however, has indicated that certain problems are encountered with all these factors during the operation of a continuous rod mill. The base cross-section of the billets on a multi-pass rod train are subject to the so-called Konti law and cannot be made of unlimited size, because each enlargement of the billet also requires an increase in number and a reduced billet entrance speed into the pre-roll line. For that reason not only is the passing time of the billet through the entire rolling train extended (which has an unfavorable influence on the heat balance) but lowering the entrance speed into the pre-roll line under 0.07 m/sec. presents the additional danger of creating heat cracks on the rolls.

The length of the rolled billets may theoretically be of any dimension, because billets from a given base cross section may as a practical matter be welded to any length. This type of operation, however, is not practical when a multi-wire rod train is to be used.

The delivery speed can theoretically be increased. Practically, however, there are limits, because the necessary auxiliary equipment such as shears, reels, etc. at the end of the train can operate safely (in the present state of the art) only up to maximum output speed of 60 m/sec.

Finally, the number of rolling lines cannot be chosen arbitrarily based on the machinery available; the limit with today's state of development lies in a four-line train.

There have been made several attempts to operate multi-line trains to obtain high production capacity and large bundle weights. For example, in German patent DT-OS No. 1,527,694 a continuous light-section steel train was revealed and has, following a furnace, a roughing train, intermediate train, and finish train, wherein the rough train and/or the intermediate train each have a single rolling line operation, but the finish train is arranged for multi-strand rolling operation and wherein each line has an added special bundle storage. The bundle storage is interchangeably supplied from the intermediate train with a rod line and is designed as after-furnace or equalization-furnace. In that way the roughing train and the intermediate train can be driven independently of the rolling speed of the finish train and the bundle storage acts as a buffer for the finish train. The base cross section of the billet entering the roughing train can thereby be enlarged without the entrance speed into the roughing train being lowered below the critical speed of 0.07 m/sec., because of the fact that the after-furnace or equalization-furnace operates as a buffer, so that the so-called Konti law is not operative.

A multi-strand roll train which is similar with respect to the after- or equalization-furnaces, but somewhat modified, has been taught by German patent DT-AS No. 1,808,822. In the arrangement shown in that patent the after- or equalization-furnace is positioned between the roughing train and the intermediate train, so that, instead of a bundle storage, a roll-through storage is provided. The multi-strand line operation also begins here in the intermediate train of the mill.

In spite of the fact that these known, continuous multi-strand trains provide an intermediate storage by the provision of the after- or equalization-furnace located in an area between one or the other successive rolling lines allow the so-called Konti law to be inoperative and thereby the possibility is presented of introducing billets into the roughing train with a base cross section of approximately 180 mm with an entrance speed of at least 0.07 m/sec., nevertheless, considerable disadvantage is still present with these known designs. Since obviously the achieveable pass reduction within the individual roller stands is limited, practically every increase of the base bar cross section requires a certain increase in the number of stands, at least within the roughing train. In case one achieves a high production capacity with large bundle weights by replacing the standard billet cross section of 100 mm with an enlarged billet cross section of 180 mm, then the plant investment for the roughing train line is more than doubled. Because of the increase in the number of stands, an extension of the roughing train is necessary, and, consequently, a longer shop for the housing of the machinery is also required. Additionally, the after- or equalization-furnaces (which serve as intermediate storage) have to be introduced into the mill to guarantee constant temperatures of the rod stock during intermediate storage; this introduction also increases still further the total expenditure because of the corresponding necessary increase of the length of the shop.

The design of the intermediate storage as after- or equalization-furnace has, in addition to the increased energy expenditure, the disadvantage that the after-heating of the rod leads to the danger of scale formation. These and other difficulties experienced with the prior art devices have been obviated in a novel manner by the present invention.

It is, therefore, the object of the present invention not only to eliminate all the disadvantages previously described in continuous multi-strand rod rolling mills, but also make it possible to use billets of large base cross section for achieving high production output and larger bundle weights.

Another object of this invention is to create a multi-strand rod rolling mill with high production capacity to produce large bundle weights, the mill having a furnace after which is provided a roughing train and a separate intermediate and finish train for each individual rod rolling line and using intermediate and finish train as used in rolling with the classic billet cross section of, for example, 100 mm and capable within the roughing train of rolling large billet cross sections up to 200 mm with a minimum number of stands without the entrance speed of the billets going below the critical speed of 0.07 m/sec. and without an increase in billet residence time in the roughing train, which increase could endanger the entire heat balance in the rod rolling mill.

With these and other objects in view, as will be apparent to those skilled in the art, the invention resides in the combination of parts set forth in the specification and covered by the claims appended hereto.

SUMMARY OF THE INVENTION

In general, the inventive solution to the complex problem is based on the previously-described rod rolling mill and mainly in the fact that the roughing train following the furnace consists of a shaping stand, an outlet roll pass, permitting free outlet of the rolling stock from the shaping stand, and with a distribution device designed as transverse conveyor device and on attached separate planetary diagonal rolling mill arranged for each pass line. The roughing train designed in this way can be supplied directly with billets of, for example, 195 or 200 mm cross-section from the furnace with an entrance speed at least 0.07 m/sec. The billets may be rolled down to 66 mm cross section by the planetary diagonal rolling mill in a single pass, so that the stock enters the intermediate train with a speed of 0.4 m/sec. The rod leaves the finish train, for example, with a cross section of 5.5 mm and an outlet speed of 60 m/sec.

In the event that square billets are introduced to the planetary diagonal rolling mill, difficulties may result by the reduction rolling in only one pass where, within a strand different material expansions occur, because the material in the corner areas of the square billets is naturally exposed to a large working deformation. This problem is eliminated (in accordance with a further characteristic of this invention) by equipping the shaping stand with a universal roller-set for octagon rolling. It has been found that reduction rolling of stock with a octagonal cross section within a planetary diagonal rolling mill leads to equally good results as are achieved by the use of stock with a circular cross section.

Since (on the one hand) the shaping stand for known reasons cannot work with an entrance speed of less than 0.7 m/sec. and (on the other hand) the roughing train, in order to obtain a safe, controllable exit speed on the end of the finish pass, cannot operate with higher entrance speed of 0.07 m/sec., then, if an intermediate storage is to be avoided, the shaping stand with the outlet roller pass is equipped with a distributor device having a transverse conveyor. The billet, which has been shaped within the shaping stand and which moves out with a speed of 0.25 m/sec., can have its total length absorbed and thereafter may be guided in accordance with requirements over the transverse distributor into the different planetary diagonal rolling mills.

The roughing train, consisting of the outlet roller pass with the distributor device and the planetary diagonal roller mills, does not use more erection space in this case than a conventional roughing train designed for a billet having a cross section of 80 mm.

A further important advantage can be achieved by this invention if a hot flame machine is added to the billet distributor device. A preliminary operation on the billets, especially a manual cleaning before the introduction into the furnace for heating, can thereby be eliminated. The elimination of any defects within the billets by the use of hot flaming after the heating will result in a optimum condition of the surface of the billets at the start of the true rolling procedure. The hot flaming of the billets is possible in accordance with this invention and is economically possible within the area of the distribution device after the billet leaves the furnace, because in this area the billets have still a cross section of 180 mm.

Since, with a multi-strand rod mill in accordance with this invention, the planetary diagonal rolling mill as well as the intermediate and finish trains always operate on a single strand, the rod rolling mill can be expanded if desired in a simple way, i.e., by adding another planetary diagonal rolling mill as well as an intermediate and finish roll line for an additional roll pass. The predominant single roll pass operation of the rod mill in accordance with this invention makes better use of an added roll pass than is possible with the known rolling mills. An efficiency of 85 percent can be achieved, as compared with 65 percent on a conventional rod rolling mill. This effect will be achieved because of the fact when there is a breakdown in the present rod mill, as compared with the conventional type, the total installation does not have to be taken out of operation, but only the area of the installation effecting a certain roll pass.

BRIEF DESCRIPTION OF THE DRAWING

The character of the invention, however, may be best understood by reference to one of its structural forms, as illustrated by the accompanying drawing, in which:

The single FIGURE is a plan view of a two-strand rolling mill constructed in accordance with the principles of the present invention.

DESCRIPTION OF THE PREFERRED EMBODIMENT

The rolling mill has two pass lines 1 and 2. On each track is located an intermediate train and a finish train. The intermediate train in the roll pass 1 is designated as $\mathbf{1^1}$ and the finish train as $\mathbf{1^2}$. The intermediate train on pass 2 is designated as $\mathbf{2^1}$ and the finish train as $\mathbf{2^2}$.

On the two roll passes 1 and 2 are also located planetary diagonal rolling mills $\mathbf{1^3}$ and $\mathbf{2^3}$, respectively, which are of the type shown and described in the U.S. Pat. No. 3,735,617 of Bretschneider. With both planetary diagonal rolling mills $\mathbf{1^3}$ and $\mathbf{2^3}$ is provided a shaping stand 4 on the discharge side of a furnace 3. An outlet roll track 5 is connected to the shaping stand 4 and extending in the direction of the planetary diagonal rolling mills $\mathbf{1^3}$ and $\mathbf{2^3}$ of the two roll passes 1 and 2. The roll axis of the shaping stand 4 and the longitudinal path of the outlet roll track are both positioned centrally of the two-strand roll pass rolling mill. To the sides of the outlet roll track 5 are attached billet-distribution devices $\mathbf{6^1}$ and $\mathbf{6^2}$ designed as lateral conveyors. The billets coming from the shaping stand 4 have their total lengths received on the outlet roll track 5 and can be transferred by the billet distribution device $\mathbf{6^1}$ to the guide roll conveyor $\mathbf{7^1}$ leading to the planetary diagonal rolling mill $\mathbf{1^3}$. In the same manner the billet distribution device $\mathbf{6^2}$ supplies the guide roll conveyor $\mathbf{7^2}$ leading to the planetary diagonal rolling mill $\mathbf{2^3}$.

The shaping stand 4 is equipped with a universal-roller set in the manner shown and described in the application GD-875 of Bretschneider et al. filed on this date. The billets coming from the furnace 3 are of square shape and of 200 mm cross-sectional area and the stand 4 shapes those billets to octagonal cross section of approximately 195 mm. Such an octagonal billet cross section is much easier to work on in the planetary diagonal rolling mills $\mathbf{1^3}$ and $\mathbf{2^3}$ than a billet of square cross-section. Surprisingly, it has been found that the use of billets with octagonal cross section produce as good results when rolled in a planetary diagonal rolling mill as billets with a circular cross section.

A billet with an octagonal cross section of 195 mm area runs with a minimum speed of 0.07 m/sec. into one of the planetary diagonal rolling mills $1^3$ and $2^3$ and is reduced there in one pass to a cross section of 65 mm and with an outlet speed of 0.4 m/sec. At this speed the rod enters, for example, a 10-stand intermediate train $1^1$ and is reduced there to a cross section of 18 mm area with an exit speed of 8.5 m/sec. Now this rod enters at this speed a 10-stand finishing train $1^2$ and is reduced to a final cross section of 5.5 mm area with an exit speed of 60 m/sec. and can be reeled.

It should be mentioned that the billet distributor devices $6^1$, $6^2$, which are designed as transverse conveyors, form an intermediate storage between the shaping stand 4 and the two planetary diagonal rolling mills $1^3$ and $2^3$. Such intermediate storage is provided, because of the fact that the billets arriving from the shaping stand 4 have an exit speed which is greater than the inlet speed of the planetary diagonal rolling mills $1^3$ and $2^3$.

The billet distribution device $6^1$, $6^2$ can purposely be equipped with a torch, which serves to eliminate defects from the surface of the billets before they are introduced into the planetary diagonal rolling mills $1^3$ and $2^3$.

Finally, it should be pointed out that it is possible to lay out the intermediate trains $1^1$ and $2^1$ and the finish trains $1^2$ and $2^2$ for each roll pass 1 and 2 in a H-V arrangement.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Rolling mill for high capacity and for producing large bundle weights, having a furnace followed by a roughing line and a separate intermediate and finish rolling line for each line of product, characterized by the fact that the roughing line consists of a shaping stand (4) located next to the furnace, a free outlet, permitting outlet roll runout (5) of the rolled stock from the shaping stand (4), with a distribution device ($6^1$, $6^2$) designed as transverse transport and arranged thereafter a planetary diagonal rolling mill ($1^3$ and $2^3$) for each roll line (1, 2).

2. Rolling mill as recited in claim 1, characterized by the fact that the shaping stand (4) is equipped with a universal roller set for octagonal rolling.

3. Rolling mill as recited in claim 1, characterized by the fact that a hot flaming machine is associated with the billet distribution device ($6^1$, $6^2$).

4. Rolling mill as recited in claim 1, wherein the shaping stand consists of a single rolling stand receiving square cross-section billets on the corner and converting them to octagonal cross section.

* * * * *